US007152282B2

(12) United States Patent
Costa

(10) Patent No.: US 7,152,282 B2
(45) Date of Patent: Dec. 26, 2006

(54) FASTENING CLIP FOR JEWELRY, HANDBAGS, ETC.

(75) Inventor: Antonio Costa, Monticello C. Otto (IT)

(73) Assignee: Cost-Cast S.R.L., Vicenza (IT)

( * ) Notice: Subject to any disclaimer, the term of this patent is extended or adjusted under 35 U.S.C. 154(b) by 8 days.

(21) Appl. No.: 11/039,318

(22) Filed: Jan. 19, 2005

(65) Prior Publication Data

US 2005/0198788 A1 Sep. 15, 2005

(30) Foreign Application Priority Data

Mar. 11, 2004 (IT) ..... VI2004A0047

(51) Int. Cl.
*A44B 21/00* (2006.01)
*A44B 11/25* (2006.01)

(52) U.S. Cl. ..... 24/303; 24/633

(58) Field of Classification Search ..... 24/66.1, 24/68 J, 71 J, 265 R, 303; 63/3, 3.1, 900; 70/459; 292/251.5; 335/285, 303, 304
See application file for complete search history.

(56) References Cited

U.S. PATENT DOCUMENTS 2,615,227 A * 10/1952 Hornik ..... 24/303
3,141,214 A * 7/1964 Bey ..... 24/303
3,177,546 A * 4/1965 Bey ..... 24/303
3,566,637 A * 3/1971 Hallmann ..... 70/276
4,231,137 A * 11/1980 Fujimoto ..... 24/303
5,367,891 A * 11/1994 Furuyama ..... 63/29.2
6,981,391 B1 * 1/2003 Suzuki ..... 24/303
6,640,398 B1 * 11/2003 Hoffman ..... 24/303
6,971,147 B1 * 12/2005 Halstead ..... 24/303
2006/0174455 A1 * 8/2006 Saitoh et al. ..... 24/303

* cited by examiner

*Primary Examiner*—Robert J. Sandy
*Assistant Examiner*—Ruth C. Rodriguez
(74) *Attorney, Agent, or Firm*—Bucknam and Archer

(57) ABSTRACT

There is disclosed a fastener for clips to be applied to jewelry and costume jewelry products and to clothing accessories, bags and the like. The fastener utilizes a mechanical device actuated through the action of magnets. According to one arrangement, the mobile components of the clip, shaped substantially in the form of small pins that carry out the mechanical fastening, consist of magnets, for which, in each pair of said permanent magnets, there is mutual attraction and therefore closing of the fastening device when they are arranged with the poles opposite, i.e. when one is arranged in such a way that its positive pole faces towards the negative pole of the other.

4 Claims, 3 Drawing Sheets

FASTENING CLIP FOR JEWELRY, HANDBAGS, ETC.

BACKGROUND OF THE INVENTION

The present invention relates to a fastening device for use in jewelry products, such as necklaces, bracelets and other ornamental products and in clothing accessories, bags, belts and the like.

In the current state of the art, fastening clips applied to necklaces and bracelets, in the field of jewelry and costume jewelry in general, are of the mechanical type and generally consist of small cylinders that, in certain positions, take care of closing mini-locks. Also, in the current state of the art, the use of so-called "magnetic" clips is widespread, where fastening is obtained through the attraction of two opposing magnets.

All of these prior art types of fastening clips have some drawbacks that limit their use. Specifically, mechanical clips, defined with the generic term "spring clips," have a constructive drawback, since they require special processing, both for making the individual components and for their assembly. Such clips also have a drawback in use, consisting of difficulty for the user to act on the opening device and unfasten the clip. Magnetic clips, even though they have a simpler construction as compared to mechanical clips, also have a drawback in use due to the fact that the two opposing magnetic bodies, so as to be able to make a stable fastening, must have a fairly strong force of attraction. Thus, a magnetic field is generated around the clip that interacts with the surrounding area, creating awkward situations for the user. For example, the drawback encountered by a person who wears a watchstrap equipped with a conventional magnetic clip finds that metal parts, such as staples, pins or other metallic elements present on his work table, are attracted to and stick to the watchstrap clip due to the effect of the external magnetic field generated by the two opposing magnets.

SUMMARY OF THE INVENTION

The object of the present invention is to provide a fastening clip to be used, in particular, in the field comprising ornamental objects and clothing accessories, which does not have the drawbacks suffered by similar known fastening clips.

The above object is accomplished with a fastening clip in which fastening is carried out through a mechanical device actuated through the action of magnets. In such a clip, the mobile components are shaped substantially in the form of small pins that carry out the mechanical fastening. These pins consist of magnets, for which, in each pair of said permanent magnets, there is mutual attraction and therefore closing of the fastening device when they are arranged with their poles opposite, i.e. when one is arranged in such a way that its positive pole faces towards the negative pole of the other.

The unfastening of the clip is carried out through a mechanical/magnetic operation wherein the two magnetic pins move apart, thus allowing the fastening mechanism to open. This moving apart of the two magnetic pins can be carried out by inserting a third magnetic element between them arranged so that its magnetic poles (positive and negative) oppose the magnetic poles of the two fastening pins, for which reason the latter pins are moved apart and therefore the opening of the mechanism and finally the unfastening of the clip is carried out.

Such moving apart of the two magnetic pins can also be carried out with a mechanical operation wherein one of the aforementioned two pins is rotated by 180°, in such a way that the two poles of the same sign face one another, with the consequence of generating a mutual repulsion and therefore the moving apart of the aforementioned two pins and finally the opening of the mechanism and the unfastening of the clip.

BRIEF DESCRIPTION OF THE DRAWINGS

The present invention will be better defined with the description of some of its possible embodiments, given only as a non-limiting example, with the help of the attached drawings, wherein.

DETAILED DESCRIPTION OF THE INVENTION

Figure 3:
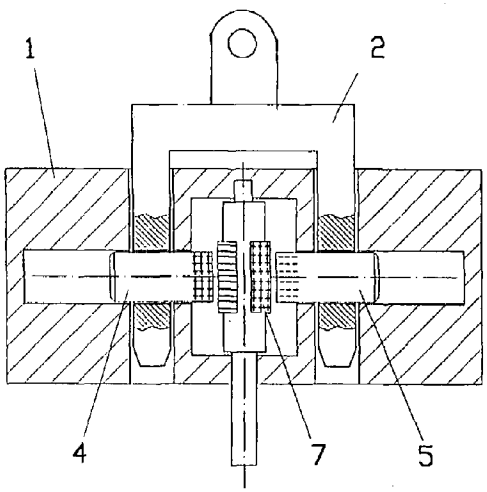
FIGS. 1, 2 and 3 represent the successive operating steps of a first type of fastener, according to the present invention.
Figure 2:
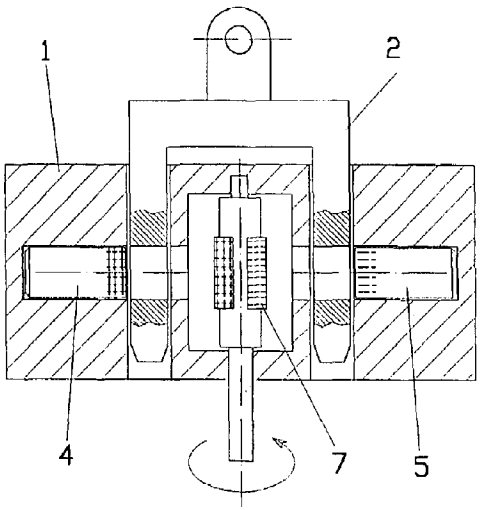
Figure 1:
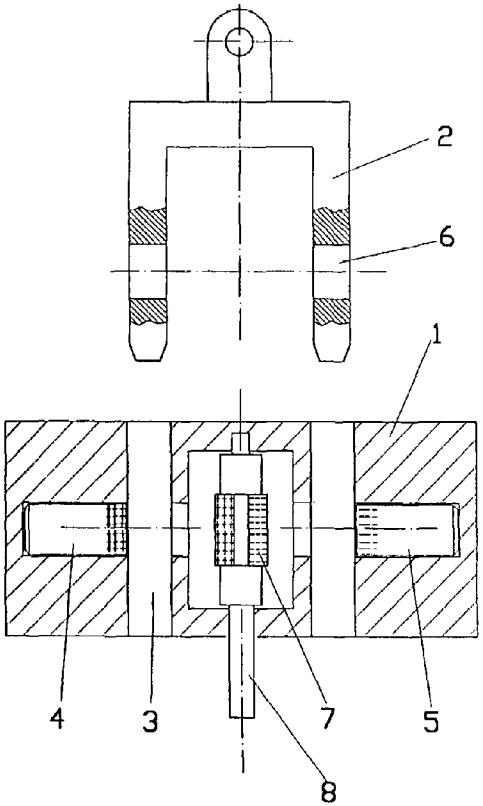

As can be seen in FIGS. 1 to 3, in a first embodiment of the invention, fastening of the clip is obtained through magnetic pins 4 and 5, arranged opposing each other and contained in the body 1. Pins 4 and 5 are inserted into the corresponding holes 6, formed on the anchor 2. The axial sliding of the two magnetic pins 4 and 5 is caused by a magnet 7 arranged between the aforementioned pins and mounted on a support 8, rotatable about its axis.

As can easily be seen from FIGS. 1 to 3, the axial movement of the two pins 4 and 5 is a consequence of the fact that the magnetic poles of the aforementioned pins are of the same sign or of opposite sign with respect to the corresponding magnetic poles of the central magnet 7.

In operation, with the fastener open (see FIG. 1), the magnetic poles of pins 4 and 5 are of the same sign as the opposing magnetic poles of the central magnet 7 for which reason, due to the repulsive force, they remain inside their seats in body 1. Thereafter, the anchor 2 is inserted manually into the recess 3 and the central magnet 7 is rotated by 180° (see FIG. 2). With such rotation, the polarities of the central magnet 7 are thus inverted, for which reason a magnetic attraction force is applied and which attracts pins 4 and 5, which, sliding, are inserted into the holes 6 of anchor 2, thus carrying out the desired fastening (see FIG. 3).

Figures 4, 5, 6:
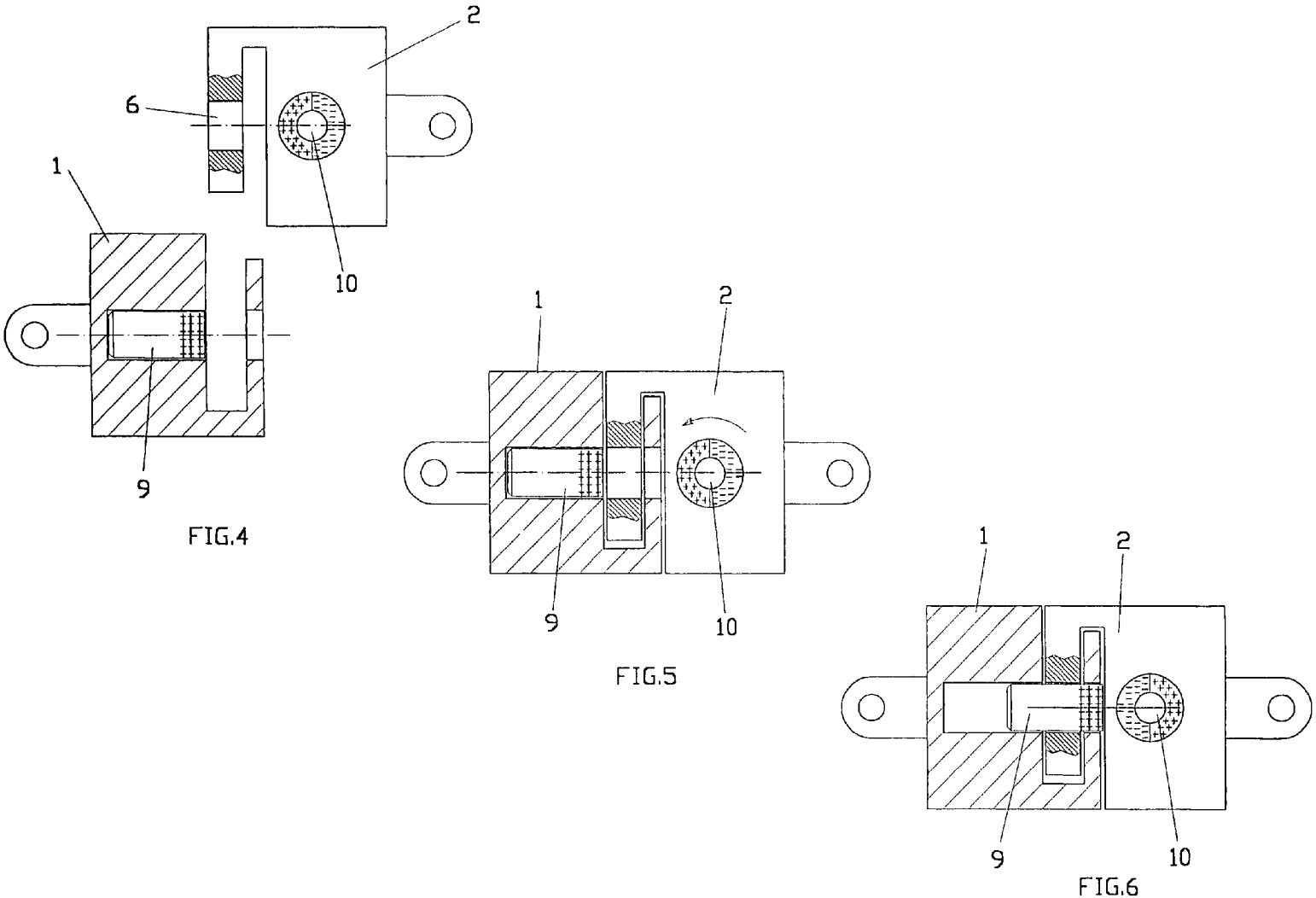
FIGS. 4, 5 and 6 represent the successive operating steps of a second type of fastener, according to the present invention.

As can be seen in FIGS. 4 to 6, in a second embodiment of the invention the fastening between the body 1 and the anchor 2 is carried out with the use of a magnetic pin 9 and a magnet 10. Pin 9 is inserted in body 1 and is adapted to slide axially whereas magnet 10 is inserted in anchor 2 and is adapted to rotate 180°. As can easily be seen from FIGS. 4 to 6, the axial sliding of pin 9 is a consequence of the fact that the magnetic poles of the pin 9 and of the magnet 10 are of the same sign or of opposite signs.

In operation, in the open state of the fastener (see FIG. 5), the opposing poles of the pin 9 and of the magnet 10 are of the same sign for which reason, due to the repulsive force, the slidable pin 9 remains inside its seat in the body 1. With the rotation by 180° of magnet 10, the polarities of the pin 9 and the magnet 10 are thus inverted, for which reason a magnetic attraction force is applied to pin 9, which, sliding, inserts into the hole 6, carrying out the desired fastening (see FIG. 6).

Figure 7:
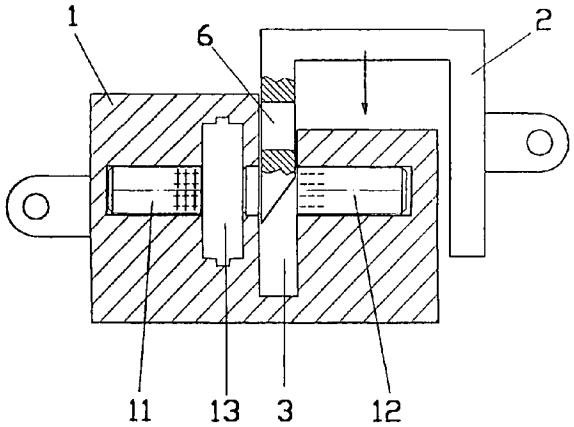
FIGS. 7, 8 and 9 represent the successive operating steps of a third type of fastener, according to the present invention.
Figure 8:
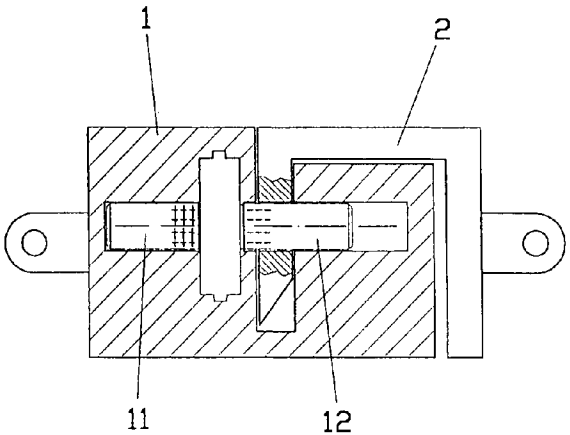
Figure 9:
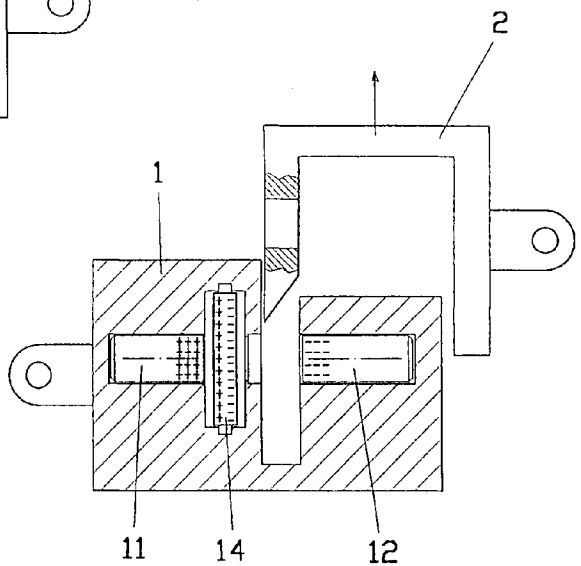

As can be seen in FIGS. 7 to 9, in a third embodiment of the invention, the fastening between the body 1 and the anchor 2 is carried out with the use of two magnetic pins 11 and 12, arranged opposite one another and both inserted in the aforementioned body 1, wherein one is fixed and the other is adapted to slide axially. The fastening operation takes place with the manual insertion of the anchor 2 in the recess 3 (FIG. 7), which is locked by the mobile pin 12 which, having the magnetic pole with the opposite sign to the magnetic pole of the fixed pin 10, is attracted and thus inserted into the hole 6 (FIG. 8), carrying out the desired fastening. As can be seen in FIG. 9, the unfastening operation is carried out by inserting a magnet 14, orientated so as to have a magnetic pole of opposite sign to the magnetic pole of the mobile pin 12, into the intermediate recess 13, which brings about a repulsive force that takes the aforementioned pin back into its seat and thus frees the anchor 2, which can thus be unfastened from the recess 3 of body 1.

Of course, embodiments different to those described are possible, according to the type of fastening clip to be made, however, without the characteristics of the following claims being affected.

What is claimed is:

1. A fastening clip for jewelry, costume jewelry and clothing accessories, comprising:

a female clip member (1) having a first axially movable magnetic pin (4) and a second axially movable magnetic pin (5) arranged in said female clip member opposite each other;

a male clip member (2) having holes (6) for axially accepting said first and second magnetic pins for mechanical fastening together of said male and female clip members; and a magnet (7) mounted for 180° rotation on a rotatable support (8) and disposed between said first and second magnetic pins, whereby when said magnet (7) is rotated so that when the magnetic poles of said first and second magnetic pins facing said magnet (7) are opposite to the magnetic poles of said magnet (7), there is a magnetic attraction and mechanical fastening of said male and female clip members, and when the magnetic poles of said first and second magnetic pins facing said magnet (7) are the same as the magnetic poles of said magnet (7), there is a magnetic repulsion and mechanical unfastening of said male and female clip members.

2. A fastening clip for jewelry, costume jewelry and clothing accessories, comprising:

a female clip member (1) having therein a magnetic pin (9) arranged for axial movement in said female clip member;

a male clip member (2); and a magnet (10) arranged in said male clip member (2) for 180° rotation, whereby when said magnet (10) is rotated so that the facing magnetic poles of said magnetic pin (9) and magnet (10) are opposite, there is a magnetic attraction and mechanical fastening of said male and female clip members, and when the facing magnetic poles of said magnetic pin (9) and magnet (10) are the same, there is a magnetic repulsion and mechanical unfastening of said male and female clip members.

3. A fastening clip for jewelry, costume jewelry and clothing accessories, comprising:

a male clip member;

a female clip member (1) having arranged therein an axially movable magnetic pin (12) and an oppositely disposed fixed magnetic pin (11); and a mechanical means for mechanically fastening together and mechanically unfastening said male and female clip members which includes magnetic pins such that when a pair of pins are arranged so that their magnetic poles are opposite, there is a magnetic attraction and mechanical fastening of said male and female clip members, and when the pair of magnetic pins are arranged so that their magnetic pins are arranged so that their magnetic poles are the same, there is a magnetic repulsion and mechanical unfastening of said male and female clip members.

4. The fastening cup as defined in claim 3, wherein said male clip member (2) includes a hole (6) for acceptance of said axially movable pin (12) when said male clip member is joined to said female clip member by insertion into a recess (3) in said female clip member, and the polarity of said axially movable pin (12) is opposite to the polarity of said fixed pin (11), and wherein a magnet (14) is insertable between the opposing axially movable pin (12) and fixed pin (11) having the same polarity as opposing axially movable pin (12) so as to mechanically unfasten said male and female clip members.

* * * * *